US006347587B2

(12) United States Patent
Ghisalberti et al.

(10) Patent No.: US 6,347,587 B2
(45) **Date of Patent: *Feb. 19, 2002**

(54) DEVICE FOR CLEANING THE OUTER SURFACE OF ROTARY CYLINDERS AND THE LIKE

(75) Inventors: Marcello Ghisalberti, Pedrengo; Lorenzo Ghisalberti, Stezzano, both of (IT)

(73) Assignee: T.G.C. S.r.l., Bergamo (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/431,325

(22) Filed: Nov. 2, 1999

(30) Foreign Application Priority Data

Nov. 3, 1998 (IT) ..... BG98A0060

(51) Int. Cl.[7] ..... B41F 35/00
(52) U.S. Cl. ..... 101/424; 101/423
(58) Field of Search ..... 101/424, 423, 101/425; 15/256.52, 256.51

(56) References Cited

U.S. PATENT DOCUMENTS

| | | | | | |
|---|---|---|---|---|---|
| 4,344,361 A | | 8/1982 | MacPhee et al. | ..... | 101/425 |
| 4,757,763 A | * | 7/1988 | MacPhee et al. | ..... | 101/425 |
| 4,986,182 A | | 1/1991 | Sawaguchi et al. | ..... | 101/483 |
| 5,117,754 A | * | 6/1992 | Nozaka et al. | ..... | 101/423 |
| 5,404,819 A | * | 4/1995 | Hishinuma et al. | ..... | 101/425 |
| 5,440,986 A | * | 8/1995 | Braun | ..... | 101/425 |
| 5,519,914 A | * | 5/1996 | Egan | ..... | 101/425 |
| 5,564,338 A | | 10/1996 | Branas | ..... | 101/424 |
| 5,797,325 A | * | 8/1998 | Ebina et al. | ..... | 101/425 |
| 5,842,418 A | * | 12/1998 | Corrado et al. | ..... | 101/424 |

FOREIGN PATENT DOCUMENTS

| | | | | |
|---|---|---|---|---|
| EP | 0257818 | | 3/1988 | |
| JP | 0008055 | * | 1/1990 | ..... 101/425 |
| JP | 09277496 | | 10/1997 | |
| WO | 9746388 | | 12/1997 | |

* cited by examiner

*Primary Examiner*—John S. Hilten
*Assistant Examiner*—Anthony H. Nguyen
(74) *Attorney, Agent, or Firm*—Steinberg & Raskin, P.C.

(57) ABSTRACT

A device for cleaning the outer surface of rotary cylinders and the like (2) comprising a pair of rotatable members (9, 11) for unwinding and rewinding a fabric (10), a presser means (12) cooperating with the fabric (10), means (50) for feeding onto the fabric (10) a liquid for cleaning the cylinder (2), and means (51) for feeding drying air onto the rotary cylinder (2), in which the pair of rotatable members (9, 11), the presser means (12) and the detergent liquid feeding means pertain to a cleaning assembly (6) movable by pneumatic drive away from and towards the rotary cylinder (2).

11 Claims, 4 Drawing Sheets

DEVICE FOR CLEANING THE OUTER SURFACE OF ROTARY CYLINDERS AND THE LIKE

FIELD OF THE INVENTION

This invention relates to a device for cleaning the outer circumferential surface of rotary cylinders or rollers used in printing machines or in other types of machine such as paper and/or film production and processing machines, on which deposits of various materials, such as ink, form and have to be removed for proper machine operation.

BACKGROUND OF THE INVENTION

The state of the art comprises cleaning devices provided with two shafts for unwinding and rewinding a fabric which is made to adhere to the rotary cylinder or roller by means of a presser member, which can be in the form of an air chamber or a blade of flexible metal or resilient material.

Because of their characteristics and method of operation, these conventional devices have drawbacks in use, and do not ensure either adequate cleaning or optimum fabric and detergent consumption. Specifically, in the case of devices comprising an air chamber, this performs two functions, namely those of bringing the fabric into contact with the cylinder and of pressing it against the cylinder. The air is fed into the air chamber and then discharged several times during each cleaning cycle, to the detriment of the elasticity of the chamber, which undergoes variation both because of pressure reduction and leakages, with immediate negative effects on operation, and because of continuing decay in the characteristics of the rubber from which the chamber is constructed. Excessive chamber air pressure or wear involve the risk of chamber bursting with consequent danger to the operator. To this can be added the traction effect exerted by the rotary cylinder on the chamber via the fabric, causing chamber deformation which cannot always be compensated by the pressure exerted by it in the contact region. In the particular case of cylinders which do not have a continuous outer circumferential surface but instead comprise, as for example in the case of blanket cylinders, a gap in the direction of the generating line, this deformation is even more evident, resulting in vibration on passing said gap during rotation, this vibration adversely affecting the quality of the contact offered by the air chamber.

In the case of cleaning devices provided with a contact blade, the pressure exerted on the cylinder via the fabric is not always uniform along the entire cylinder length, and any irregularities in its surface or even minimum misalignment between the blade and the cylinder axis prevent its proper cleaning. In the case of the aforesaid discontinuous cylinders the said vibration problem also exists, in that the blade is unable to maintain the fabric in contact with the cylinder surface, not because of deformation but because of its limited flexibility and elasticity.

In an attempt to at least partly solve the said problems, it is usual to increase the cleaning time even though this results in greater fabric and detergent consumption.

OBJECTS AND SUMMARY OF THE INVENTION

The main object of the invention is to provide a cleaning device which is quick and simple in use and results in proper and efficient cylinder or roller cleaning and an appreciable saving in fabric and detergent.

This and other objects which will be more apparent from the ensuing detailed description are attained by a cleaning device in accordance with the accompanying claims.

BRIEF DESCRIPTION OF THE DRAWINGS

The invention will be more apparent from the detailed description of a preferred embodiment thereof given hereinafter by way of non-limiting example and illustrated on the accompanying drawings, on which.

DETAILED DESCRIPTION OF THE PREFERRED EMBODIMENTS

Figure 1:
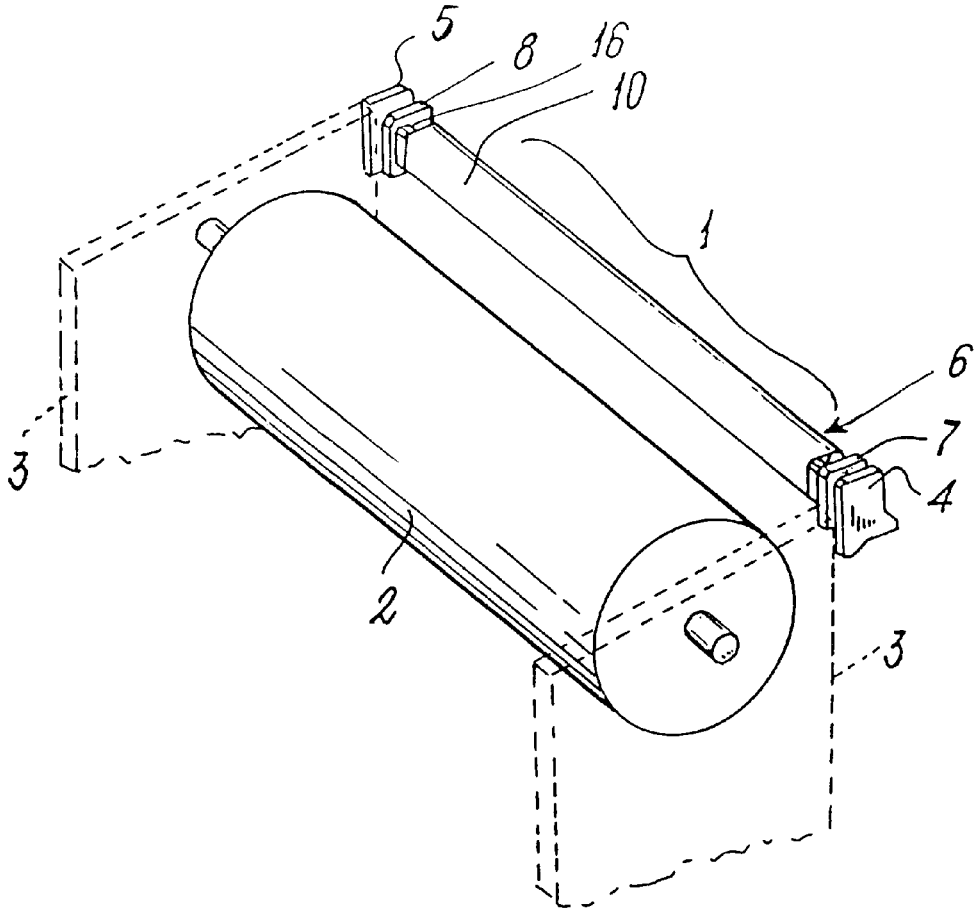
FIG. 1 is a perspective schematic view of the cleaning device of the invention, together with a cylinder to be cleaned by the device.

In the figures, the reference numeral 1 indicates overall the device of the invention. The device is intended to clean the cylindrical surface of a cylinder 2, for example of a printing machine, without the cylinder having to be removed from the machine which rotates it (not only during printing but also during its cleaning by the device of the invention).

The cleaning device is located in front of and parallel to the cylinder as shown in the figures.

The printing machine comprises a support structure shown schematically as two parallel side walls 3 in which the cylinder 2 is mounted. Two lateral shoulders 4, 5, forming part of the device of the invention and intended for the support and movement of the actual cleaning part 6 of the device, are fixed to said side walls, for example removably, by any known means, for example by screw means. This cleaning part 6 is movable away from and towards the cylinder to be cleaned. The cleaning part 6 comprises at its respective ends two parallel shoulders 7, 8. Between these shoulders 7, 8 there is rotatably and removably supported a shaft 9 on which a fabric 10 operating on the cylinder 2 for its cleaning is directly or indirectly wound. Constant lengths of the fabric 10 are unwound intermittently from the shaft 9 at a given frequency. During its unwinding the fabric is wound directly or indirectly onto an underlying removable shaft 11 driven by motor means described hereinafter.

During operation, the fabric 10 passes from one shaft 9 to the other 10, coming into contact with the surface of the cylinder 2 to be cleaned in correspondence with a presser member 12 described in detail hereinafter.

As stated, the two shafts 9 and 11 are removably mounted between the two shoulders 7 and 8 by a known rapid-release support system comprising for example support elements having a cavity into which the end of the shafts 9 and 11 is inserted and retained therein by a pin or ball with a counteracting spring.

Such an arrangement enables the fabric to wind onto and unwind from the shafts 9 and 11, not directly but by way of tubes 13, 14 for example of plastic or cardboard which are mounted on said shafts (before being mounted between the shoulders 7, 8), to which the tubes 13, 14 can be secured by the action of pneumatic or mechanical radial expansion plugs 15 emerging from the shafts.

Using this solution the fabric 10 can be quickly replaced and easily reused, as the shafts 9 and 11 can be quickly removed and the fabric support tubes 13, 14 be replaced on the two shafts without having to manually unwind the fabric from one shaft and then rewind it onto the other.

The lack of the fabric is indicated by conventional sensors, for example microswitches, not shown, which provide a warning and halt the cleaning operation.

The cleaning part 6 also comprises, fixed to the shoulders 7, 8, a crosspiece 16 partially covered with a housing 17, for example of stainless steel. The presser member 12 comprising a tubular chamber 18 of elastic material, preferably rubber, is fixed to the crosspiece 16. This tubular chamber comprises a substantially flat base 18A incorporating a metal plate 19 embedded along its periphery in the elastic material to form a perimetral flange 24 to which, at least at one of its points, there is fixed a projecting nozzle 20 incorporating a non-return valve, to engage in an exit port 21 of a duct 22 passing longitudinally along the crosspiece 16. A metal frame 23, fixed to the crosspiece 16 by studs distributed along its perimeter, locks the tubular chamber by securing it to the crosspiece via said flange 24.

The tubular chamber 18 is intended to be filled via the duct 22 with water or another fluid or, for some applications, with a viscoelastic substance, for example a polymer, at a predetermined pressure, to form a presser member (for the fabric against the perimeter of the cylinder 2 to be cleaned) which presents an adequate region of contact against the cylinder to be cleaned, in terms both of dimensions and of elasticity.

In contrast to known pneumatic cleaning devices in which the approach and withdrawal of the fabric 10 to and from the cylinder 2 and the application of the fabric against the cylinder are achieved by merely inflating/deflating an air chamber, in the device of the invention the approach and withdrawal of the fabric and its contact pressure are determined by the pneumatic cylinder-piston units 25, 26, whereas the surface optimization in the contact region and the relative degree of elasticity are determined by the hydraulic chamber 18 and are a function of the pressure of the liquid contained in it.

It is always possible to find a proper balance between the damping capacity of the chamber 18 and the necessary thrust of the pneumatic cylinder-piston units 25, 26, without having to be excessive with this latter, to the advantage of a considerable reduction in vibration and noise at their source.

In this respect, experimental tests have demonstrated the evident advantages deriving from the water or other liquid chamber 18 to reduce and absorb the vibration generated by the rotation of the cylinder 2 and its contact with the device of the invention, and to effectively compensate the pressure differences encountered along the contact region caused by flexure or by minimal misalignment between the device and the axis of the cylinder 2, and by imperfections in the surface to be cleaned (sometimes deriving from non-uniform deposition of the residues to be removed).

The fabric 10 can thus adhere perfectly to the cylinder 2, to best perform its mechanical action, which contributes to chemical detergent action for cleaning purposes, and to air blowing action for drying purposes.

Figure 3:
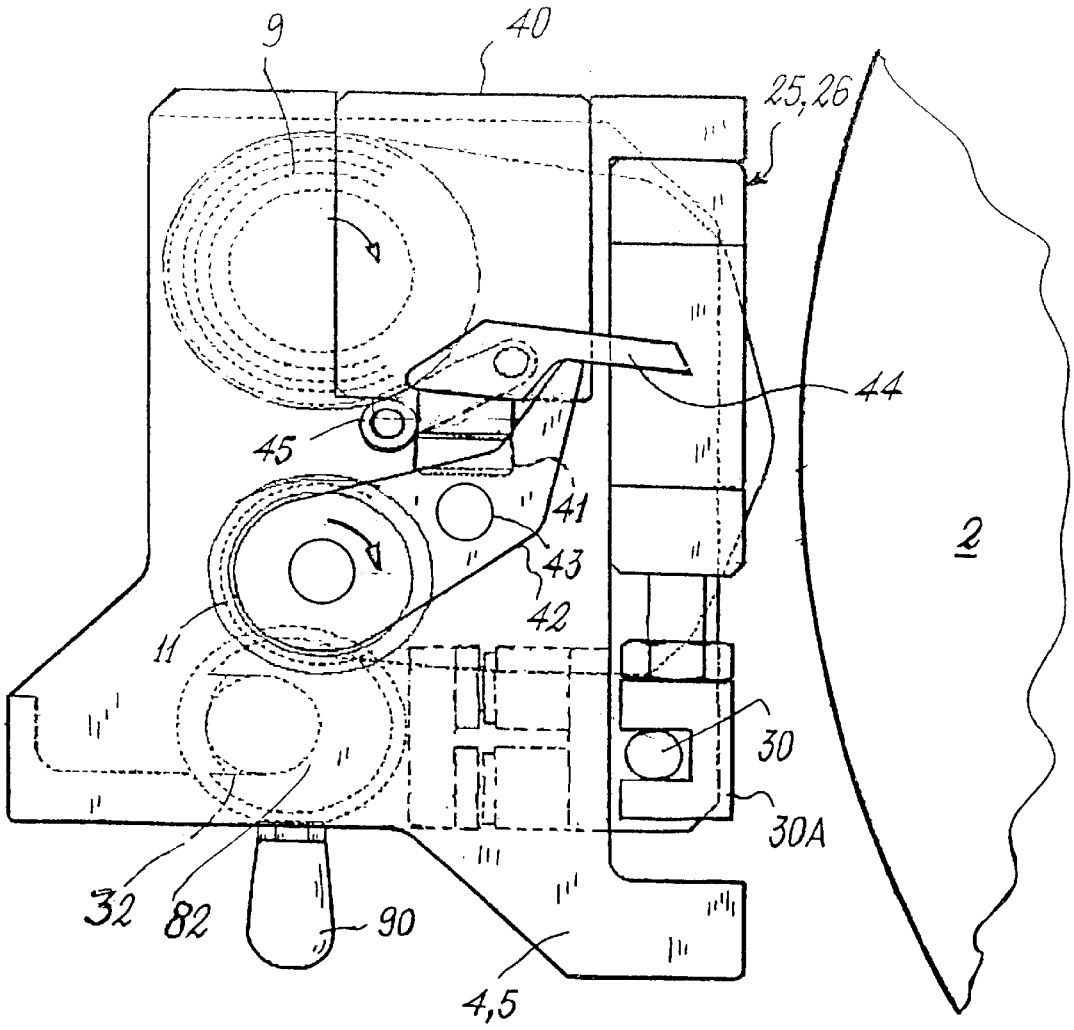
FIG. 3 is a side view of the device.

As stated, two pneumatic cylinder-piston units 25, 26 are provided for moving the cleaning part 6 away from and towards the cylinder 2. These cylinder-piston units are visible in FIGS. 3 and 4, and rotate the cleaning part 6 in such a manner as to apply it to or withdraw it from the cylinder. Each pneumatic cylinder-piston unit 25, 26 is rigid with the fixed shoulders 4, 5. A U-piece or fork 30A is provided at the end of the relative rod 30. In each U-piece 30A there is provided a pin 31 projecting outwards from each of the shoulders 7, 8. These have a further pin 32 acting as a pivot for the movable cleaning part 6 and arranged as described hereinafter in a seat provided in the fixed shoulders 4, 5. By operating the pneumatic cylinder-piston units 25, 26 the cleaning part 6 is made to approach or withdraw from the cylinder 2.

Advantageously, as described hereinafter, the connection between the cleaning part 6 and the fixed shoulders 4, 5 is such (see FIG. 4) as to enable it to be removed.

Figure 2:
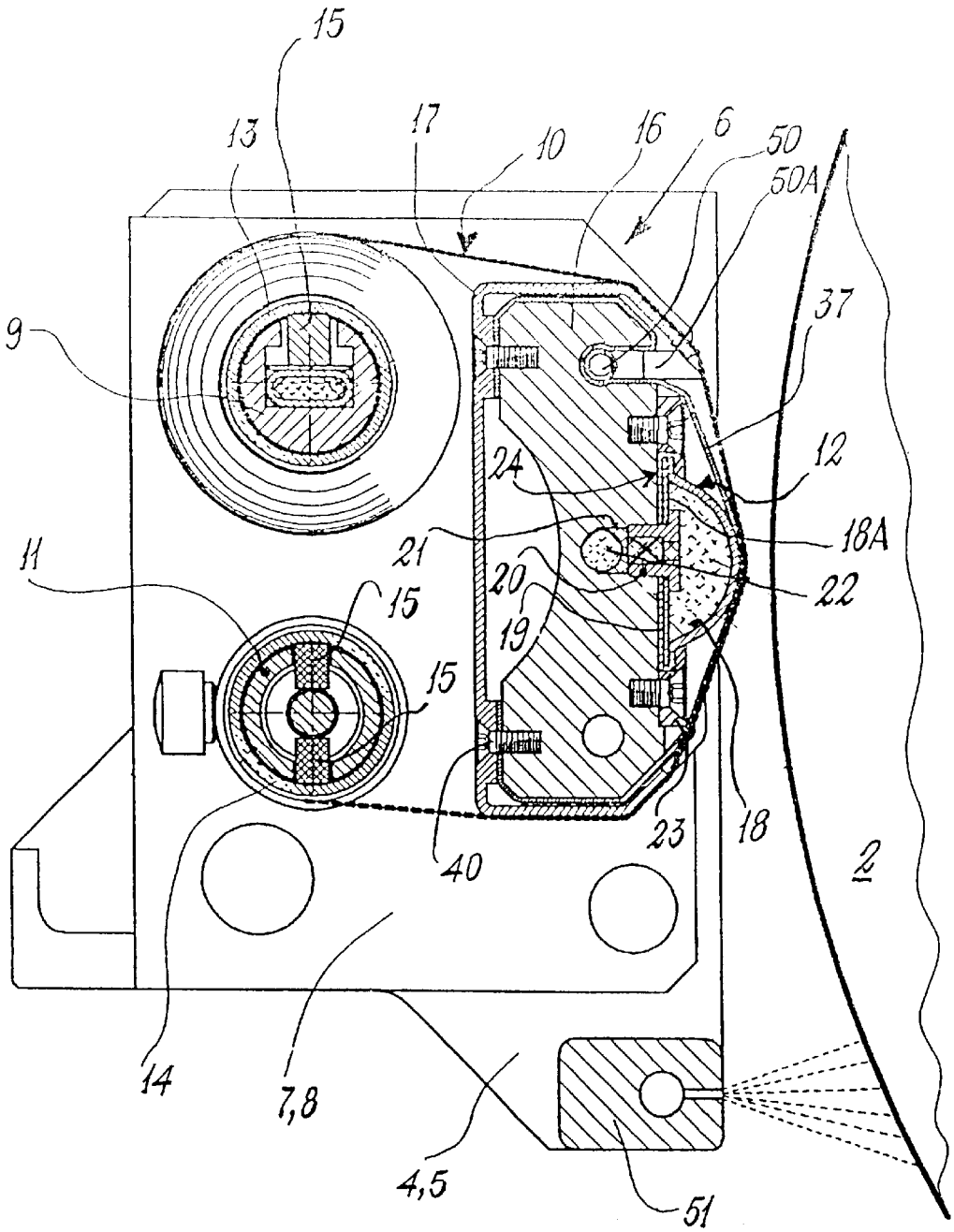
FIG. 2 is a vertical cross-section through the cleaning device.

On the hydraulic chamber 18 there is superposed a diaphragm 37, for example of nylon or rubber, which becomes interposed between said chamber and the fabric 10 to facilitate, by virtue of its low coefficient of friction, the sliding of the fabric by being resistant to abrasion and to the detergents used. As can be seen in FIG. 2, the diaphragm is fixed along its perimeter to the crosspiece 16, between this and the housing 17, by means of the same screws 40 which fix the housing to the crosspiece.

If cleaning blanket cylinders of printing machines, it has been found to be effective to use for example the same rubber as the blanket for the chamber covering diaphragm, by virtue of its gauged thickness, its perfect surface finish, its tear resistance and its total compatibility with the detergents used on it. The filling liquid is fed into the tubular chamber 18 on installation, via the non-return valve mounted in the nozzle or nozzles 20, until attaining the required pressure, indicated by a pressure gauge (not shown). After a number of wash cycles and several months of operation it may be necessary to restore the correct liquid pressure, easily done by using any source having the required pressure.

In an advantageous variant of the device, the operating pressure of the liquid contained in the chamber 18 is automatically restored after a predetermined time and/or after a given number of wash cycles, this being achievable for example by means of a sensor, for example a pressure switch, operating via a circuit on a feed valve for the pressurized liquid.

In the top of the crosspiece 16 there is located a detergent distributor consisting of a tube 50 having a series of holes of suitable diameter and distance apart, extending in the longitudinal direction of the crosspiece 16 within an outwardly open channel 50A. To ensure good distribution the detergent liquid is fed from both ends and/or at several points of the distributor tube 50 through valves from a pressurized feed source, not shown. The exit holes for the detergent liquid face the outer housing 17, adjacent to them, so that the detergent is not sprayed directly onto the fabric but instead reaches it "by reflection" and in this manner well distributed and without soiling adjacent machine parts.

A tube 51 with holes along its entire length and arranged between the fixed shoulders 4 and 5 feeds drying air against the surface of the cylinder 2 at the end of the cycle, this tube being connected to a valve-controlled compressed air source.

To produce constant intermittent advancement of the fabric 10 there is provided (see FIG. 3) on one of the shoulders 7, 8 a further pneumatic cylinder-piston unit 40A of fixed stroke. The rod 41 of this unit acts on a lever 42 via a transverse pin 43 thereof. The lever 42 rotates the support for the shaft 11 (which carries the soiled fabric), to which it is connected by a "freewheel" anti-return device. A second lever 44 is connected to a mechanical feeler 45 which under the action of a spring (not shown) adheres to the clean fabric present on the shaft 9. This lever 44 varies its position (by rotating) on the basis of the position assumed by the feeler 45.

When in operation, the cylinder-piston unit 40 rotates (clockwise) the lever 42 which, under the action of a spring (not shown), then returns to its initial rest position to halt against the lever 44.

The position of the feeler 45, the position of the lever 44 rigid with it, and consequently the rest position in which the lever 42 lies prior to its rotation vary according to the quantity (diameter) of fabric wound on the feed shaft 9.

As the fabric advancement depends on the degrees of (clockwise) rotation which the lever 42 undergoes from its initial rest position by the action of the cylinder-piston unit 40, it varies on the basis of the position assumed by the lever 42 when in its rest position.

Specifically, the closer the lever 42 lies to the rod 41, the more its stroke is utilized and the greater the rotation of the lever, hence the greater the advancement of the fabric.

The shape of the levers 42 and 44 and their relative position are chosen to provide constant fabric advancement.

In a modified embodiment, the mechanical system for advancing the fabric can be replaced by one or two electric or pneumatic motors rotating one or both the fabric-carrying shafts.

The detergent reaches the tube 50 of the cleaning part 6 via an automatic plug-in connector comprising a male part 70 rigid with the outer face of the shoulder 7 (see FIG. 4), close to the pivot pin 32, and plugging into a corresponding female part 71 elastically secured to the inner side of the fixed shoulder 4 in such a manner as to be able to follow the (limited) movements of the cleaning part 6 and hence of the connector part 70 relative to the fixed shoulders 4, 5.

A second automatic plug-in connector similar to the preceding and similarly positioned, comprising the mutually insertable components 80, 81, performs the function of automatically filling the hydraulic chamber 18 to the required pressure via the duct 22.

Figure 4:
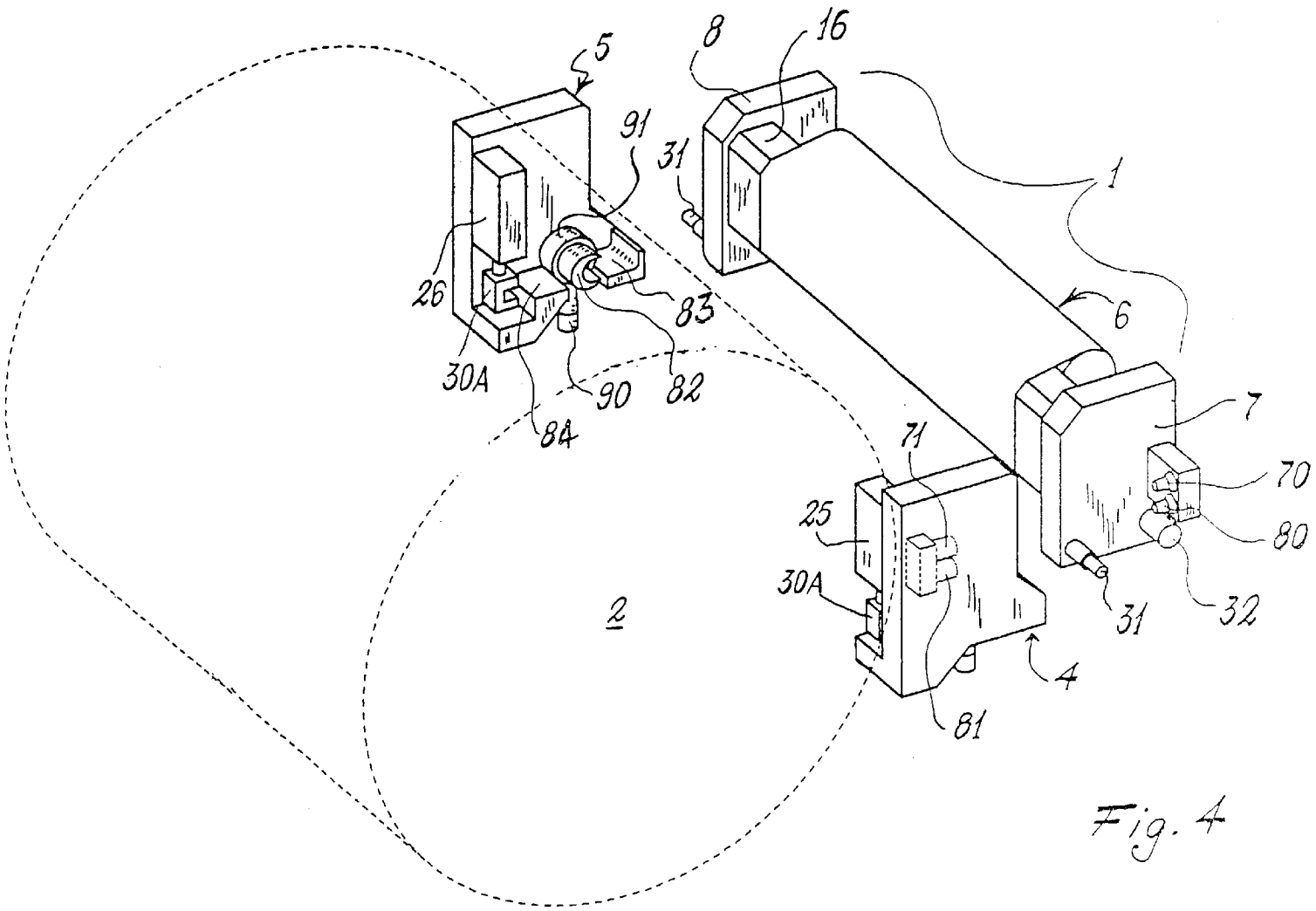
FIG. 4 is a schematic view, with some parts omitted for representational simplicity, showing the cleaning device of the invention and the means which enable it to be rapidly mounted on and removed from the parts which support it.

As already stated and as shown in FIG. 4, the cleaning part 6 is removable. In this respect, as already indicated, the cleaning part 6 is provided, for each of the lateral shoulders 7, 8, with a cylindrical rear pin 32 and a cylindrical front support pin 31, whereas each of the fixed shoulders 4, 5 comprises, on its inner side, flat support and guide surfaces 83, 84, support and fixing elements 82, and the already stated U-pieces 30A relative to the pneumatic cylinder-piston units 25, 26.

To mount the removable cleaning part 6 of the device of the invention on the machine for which it is intended, it is brought into contact with the fixed shoulders 4, 5 rigid with the machine, by resting its rear support pins 32 on the flat support and guide surfaces 83 of both the fixed shoulders 4, 5, then the entire part 6 is rotated about the pivots in the form of the rear pins 32 until the front support pins 31 enter into contact with the support and guide surfaces 83, 84. The movable part 6 is then thrust in the direction of the cylinder 2 until the rear pins 32 enter the hollow support elements 82 and the front pins 31 enter the U-pieces 30A.

For each side, the arm 90 of an outer slidable ring 91 mounted on the support element 82 is then slid axially towards the part 6 to close the hollow region of the support element 82 previously used for inserting the pin 32 into it. This ensures that the pin 32 is retained in the support element 82, the aperture of which is closed by the ring 91 and by the entire movable part 6 against the shoulders 4 and 5 fixed to the machine.

Operating the pneumatic cylinder-piston units 25 and 26 causes the cleaning part 6 to move about its rotation pivots in the form of the rear support pins 32, to cause it to move towards or away from the surface of the rotary cylinder 2.

On mounting the cleaning part 6 in the aforedescribed manner, when thrusting said part in the direction of the cylinder 2 the two male and female components of the plug-in connectors 70, 71 and 80, 81 automatically engage each other without the operator having to act on them.

According to a particular aspect of the invention, one and the same device can be used to clean two or even three adjacent cylinders or rollers. For this purpose it is sufficient, for example, to make the device movable (together with the shoulders 4, 5, no longer fixed) along rectilinear guides parallel to the cylinders, either manually or by motors, for example pneumatic.

Alternatively it can be made rotatable about a support axis parallel to the axis of the crosspiece.

When in operation the device performs four main functions, namely detergent feed and distribution, fabric advancement, approach to and withdrawal from the cylinder, and cylinder drying.

On cycle commencement the detergent is fed in the correct quantity to the distributor tube 50 which sprays it onto the fabric along its entire length.

The fabric wetted in this manner is made to adhere to the rotary cylinder 2 in the region in front of the chamber 18, under the action of the pneumatic cylinder-piston units 25 and 26 which move the movable part 6.

During the next stage these latter retract the movable part 6 from the cylinder so that the fabric is no longer in contact with it and can be advanced by unwinding it from the feed shaft 9 and winding it onto the take-up shaft 11. Detergent is again sprayed to wet the fabric 10 prior to its advancement.

The cycle comprising detergent distribution, fabric advancement and approach/withdrawal is repeated a number of times in accordance with the program chosen on the basis of the quantity of impurities and residues to be removed from the cylinder.

After washing, an air blast from the tube 51 dries the cylinder 2.

What is claimed is:

1. A device for cleaning the outer surface of a cylinder comprising:

a cleaning assembly wherein said cleaning assembly comprises:

a first pair of shoulders;

first and second rotatable members adapted for unwinding and rewinding a length of fabric, said length of fabric having a first end coupled to said first rotatable member and a second end coupled to said second rotatable member, each of said first and second rotatable members having a first end removably coupled to one of said first pair of shoulders and a second end removably coupled to another one of said first pair of shoulders;

presser means arranged between said first and second rotatable members for extending a portion of said length of fabric toward said cylinder, said presser means comprising an elastically deformable tubular chamber filled with a liquid at a selected pressure to thereby provide said tubular chamber with a constant shape;

means for applying to said fabric a liquid for cleaning said cylinder, said means for applying said liquid being coupled to said pair of shoulders; and means for applying air to said cylinder, said means for applying air to said cylinder coupled to said pair of shoulders;

said device further comprising means for adjusting the position of said cleaning assembly relative to said outer surface of said cylinder to thereby enable an adjustment of a position of said presser means from a position spaced from said outer surface of said cylinder to a position in contact with said outer surface of said cylinder.

2. A device as claimed in claim 1, wherein a non-return valve is provided at an inlet to said tubular chamber.

3. A device for cleaning the outer surface of a cylinder comprising:

a cleaning assembly wherein said cleaning assembly comprises:

a first pair of shoulders;

first and second rotatable members adapted for unwinding and rewinding a length of fabric, said length of fabric having a first end coupled to said first rotatable member and a second end coupled to said second rotatable member, each of said first and second rotatable members having a first end removably coupled to one of said first pair of shoulders and a second end removably coupled to another one of said first pair of shoulders;

presser means arranged between said first and second rotatable members for extending a portion of said length of fabric toward said cylinder, said presser means comprising an elastically deformable tubular chamber filled with a liquid at a selected pressure to thereby provide said tubular chamber with a constant shape;

means for applying to said fabric a liquid for cleaning said cylinder, said means for applying said liquid being coupled to said pair of shoulders; and means for applying air to said cylinder, said means for applying air to said cylinder coupled to said pair of shoulders;

said device further comprising means for adjusting the position of said cleaning assembly relative to said outer surface of said cylinder to thereby enable an adjustment of a position of said presser means from a position spaced from said outer surface of said cylinder to a position in contact with said outer surface of said cylinder and wherein said cleaning assembly comprises a crosspiece to which said tubular chamber and said means for applying to said fabric a liquid are coupled, said crosspiece being coupled to said first pair of shoulders, and wherein said device further comprises a diagram coupled to said crosspiece and structured and arranged to extend between said tubular chamber and said fabric.

4. A device as claimed in claim 3, wherein said diaphragm is constructed from a material having a low coefficient of friction.

5. A device as claimed in claim 1, further comprising means for rotating at least one of said rotatable members to intermittently advance said length of fabric by constant lengths.

6. A device as claimed in claim 1, said device further comprising a pair of fixed shoulders structured and arranged to be mounted to a machine provided with said cylinder to be cleaned and wherein said cleaning assembly is structured and arranged for removably coupling to said pair of fixed shoulders.

7. A device as claimed in claim 5, wherein said means for applying air to said cylinder is arranged between said fixed shoulders.

8. A device as claimed in claim 1, wherein said tubular chamber has a flange about its perimeter for securing said tubular chamber to said first pair of shoulders.

9. A device for cleaning the outer surface of a cylinder comprising:

a cleaning assembly wherein said cleaning assembly comprises:

a first pair of shoulders;

first and second rotatable members adapted for unwinding and rewinding a length of fabric, said length of fabric having a first end coupled to said first rotatable member and a second end coupled to said second rotatable member, each of said first and second rotatable members having a first end removably coupled to one of said first pair of shoulders and a second end removably coupled to another one of said first pair of shoulders;

presser means arranged between said first and second rotatable members for extending a portion of said length of fabric toward said cylinder, said presser means comprising an elastically deformable tubular chamber filled with a liquid at a selected pressure to thereby provide said tubular chamber with a constant shape;

means for applying to said fabric a liquid for cleaning said cylinder, said means for applying said liquid being coupled to said pair of shoulders; and means for applying air to said cylinder, said means for applying air to said cylinder coupled to said pair of shoulders;

said device further comprising means for adjusting the position of said cleaning assembly relative to said outer surface of said cylinder to thereby enable an adjustment of a position of said presser means from a position spaced from said outer surface of said cylinder to a position in contact with said outer surface of said cylinder and wherein said means for adjusting the position of said cleaning assembly comprises a pneumatic drive assembly.

10. A device as claimed in claim 6, further comprising automatic plug-in connectors arranged between said first pair of shoulders of said cleaning assembly and said pair of fixed shoulders.

11. A device as claimed in claim 6, wherein said means for adjusting the position of said cleaning assembly comprises a pair pneumatic cylinder-piston units, each one of said pair of pneumatic cylinder-piston units being mounted to a respective on of said fixed pair of shoulders, and wherein said each one of said first pair of shoulders of said cleaning assembly are structured and arranged to be hingedly mounted to a respective one of said pair of pneumatic cylinder-piston units.

* * * * *